US005303472A

United States Patent [19]

Mbanugo

[11] Patent Number: 5,303,472

[45] Date of Patent: Apr. 19, 1994

[54] CARD DICER APPARATUS

[76] Inventor: Linus O. Mbanugo, Box 30321, Birmingham, Ala. 35237

[21] Appl. No.: 9,056

[22] Filed: Jan. 26, 1993

[51] Int. Cl.[5] ..... B26B 27/00

[52] U.S. Cl. ..... 30/124; 30/279.2; 30/303; 30/305; 83/167; 241/95; 312/330.1; 312/333

[58] Field of Search ..... 30/303, 304, 305, 312, 30/124, 279.2; 241/95; 83/167; 312/330.1, 333, 352

[56] References Cited

U.S. PATENT DOCUMENTS

| | | | |
|---|---|---|---|
| 2,465,266 | 3/1949 | Rieder | 83/167 |
| 2,801,663 | 8/1957 | Lindauer, Jr. | 30/304 |
| 4,116,512 | 9/1978 | Wiser | 312/330.1 |
| 4,383,365 | 5/1983 | Metzigian | 30/304 |
| 4,754,676 | 7/1988 | Wessels | 83/167 |

FOREIGN PATENT DOCUMENTS

| | | | |
|---|---|---|---|
| 849318 | 8/1970 | Canada | 30/124 |
| 218784 | 2/1910 | Fed. Rep. of Germany | 30/304 |

*Primary Examiner*—Hien H. Phan
*Attorney, Agent, or Firm*—Leon Gilden

[57] ABSTRACT

An apparatus to effect the dicing of credit cards to prevent their inadvertent and unauthorized use is provided to include confronting faces, with the first face of a first housing having a matrix of lug members in a parallel relationship received within lug openings defined by orthogonally intersecting rows of first and second cutter blades. The apparatus is arranged to include slide drawer structure to permit the selective accommodation for disposal of the pieces thusly cut.

3 Claims, 4 Drawing Sheets 10
11
12
13
14
15
16
17
18
19
20
38
39
40
C

CARD DICER APPARATUS

BACKGROUND OF THE INVENTION

1. Field of the Invention

The field of invention relates to cutting apparatus, and more particularly pertains to a new and improved card dicer apparatus wherein the same is arranged to effect the severing of credit cards and the like.

2. Description of the Prior Art

Credit cards and charge card receipt carbons are frequently disposed of in refuse containers and the like, typically when a replacement credit card is availed to the user. The credit card thusly disposed is frequently provided with remaining time of validity permitting unauthorized reuse of the thusly disposed credit card. The instant invention attempts to overcome deficiencies of the problems of severing in a convenient and non-usable manner of a disposed credit card by placing such credit card between spaced confronting housing faces to provide for the severing to components of such credit card structure and in this respect, the present invention substantially fulfills this need.

SUMMARY OF THE INVENTION

In view of the foregoing disadvantages inherent in the known types of dicer apparatus now present in the prior art, the present invention provides a card dicer apparatus wherein the same is arranged to effect the dicing of a credit card directed within the apparatus structure. As such, the general purpose of the present invention, which will be described subsequently in greater detail, is to provide a new and improved card dicer apparatus which has all the advantages of the prior art dicer apparatus and none of the disadvantages.

To attain this, the present invention provides an apparatus to effect the dicing of credit cards to prevent their inadvertent and unauthorized use, to include confronting faces, with the first face of a first housing having a matrix of lug members in a parallel relationship received within lug openings defined by orthogonally intersecting rows of first and second cutter blades. The apparatus is arranged to include slide drawer structure to permit the selective accommodation for disposal of the pieces thusly cut.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved card dicer apparatus which has all the advantages of the prior art dicer apparatus and none of the disadvantages.

It is another object of the present invention to provide a new and improved card dicer apparatus which may be easily and efficiently manufactured and marketed.

It is a further object of the present invention to provide a new and improved card dicer apparatus which is of a durable and reliable construction.

An even further object of the present invention is to provide a new and improved card dicer apparatus which is susceptible of a low cost of manufacture with regard to both materials and labor, and which accordingly is then susceptible of low prices of sale to the consuming public, thereby making such card dicer apparatus economically available to the buying public.

Still yet another object of the present invention is to provide a new and improved card dicer apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 9 is an enlarged isometric illustration of the second housing structure.

FIG. 10 is an orthographic view, taken along the lines 10—10 of FIG. 9 in the direction indicated by the arrows.

DESCRIPTION OF THE PREFERRED EMBODIMENT

Figure 2:
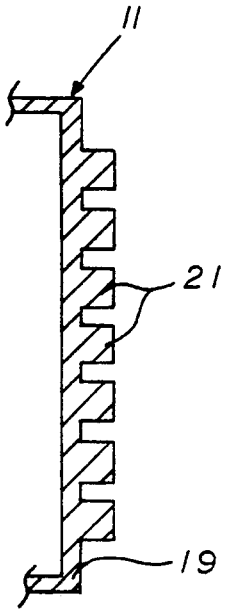
FIG. 2 is an orthographic view, taken along the lines 2—2 of FIG. 1 in the direction indicated by the arrows.

With reference now to the drawings, and in particular to FIGS. 1 to 12 thereof, a new and improved card dicer apparatus embodying the principles and concepts of the present invention and generally designated by the reference numeral 10 will be described.

Figure 1:
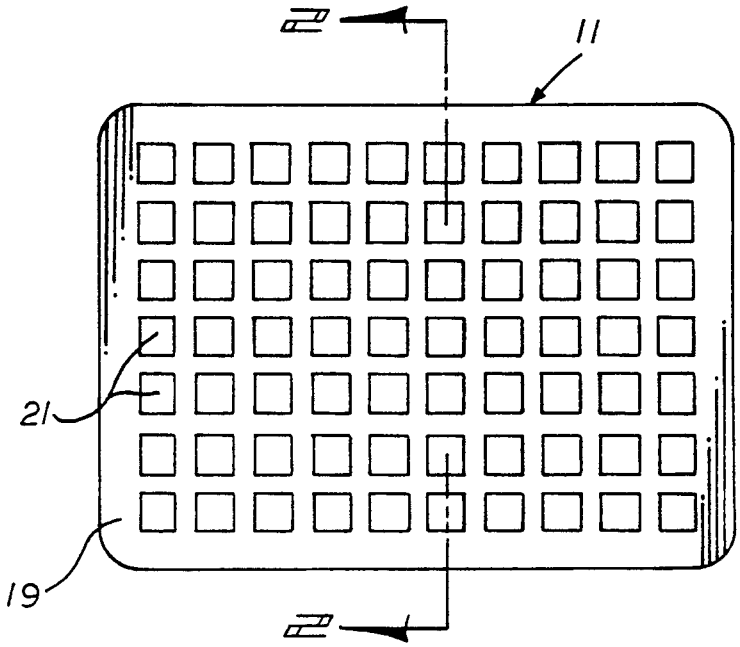
FIG. 1 is an orthographic view of the facing wall of the first anvil housing.
Figure 4:
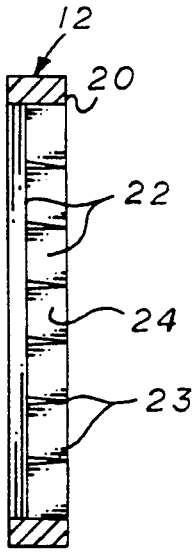
FIG. 4 is an orthographic view, taken along the lines 4—4 of FIG. 3 in the direction indicated by the arrows.
Figure 3:
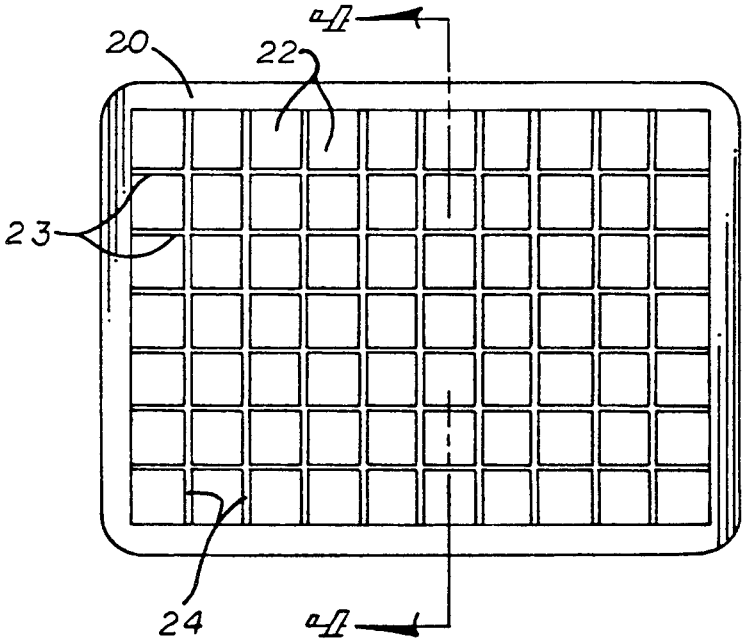
FIG. 3 is an orthographic view of a facing wall of the second anvil housing.

More specifically, the card dicer apparatus 10 of the instant invention essentially comprises a first anvil housing 11 arranged for pivoting and confronting relationship relative to a second anvil housing 12. A first handle 13 is fixedly mounted to the first anvil housing 11 to a first anvil housing rear wall, with a second anvil housing rear wall mounting a second handle 14, with the first and second handles 13 and 14 pivotally mounted relative to one another and crossed, as indicated in the FIG. 5, about a handle axle 15. The first handle including a first handle groove 16, the second handle having a second handle groove 17 in confronting relationship mounting a spring 18 therebetween to bias the handles apart and maintain the first and second anvil housings 11 and 12 in a spaced relationship. A first housing punch wall 19 is arranged in facing relationship relative to a second housing cutter wall 20. The first housing punch wall 19 includes a matrix of parallel lug members 21 projecting beyond the first housing punch wall 19 in an orthogonal relationship in parallel rows and columns, as illustrated in FIGS. 1 and 2 for example. The lug members 21 are received in companion lug openings 22 directed into the second housing cutter wall 20 defined by parallel rows of first cutter blades 23 orthogonally intersecting parallel rows of second cutter blades 24. In this manner, squeezing the first and second handles 13 and 14 together effects projection of the lug members 21 through the lug openings 22, wherein a credit card "C", such as indicated in FIG. 8, positioned between the first and second housing walls 19 and 20 is severed into indistinguishable components.

The second housing having a second housing front wall 25 includes respective first and second front wall openings 26 and 27, each positioned at an intersection with the second housing floor 28. First and second containers 29 and 30 are reciprocatably received through the first and second openings 26 and 27, with the containers having respective first and second container handles 31 and 32 for ease of manipulation of the containers.

The first and second containers 29 and 30 each include respective first and second container ferrous metallic rear walls 33 and 34 for engagement with respective first and second magnetic plates 36 and 37 mounted to the second housing rear wall 35 in confronting relationship relative to the respective first and second ferrous metallic rear walls 33 and 34.

Figures 5, 6, 7, 8:
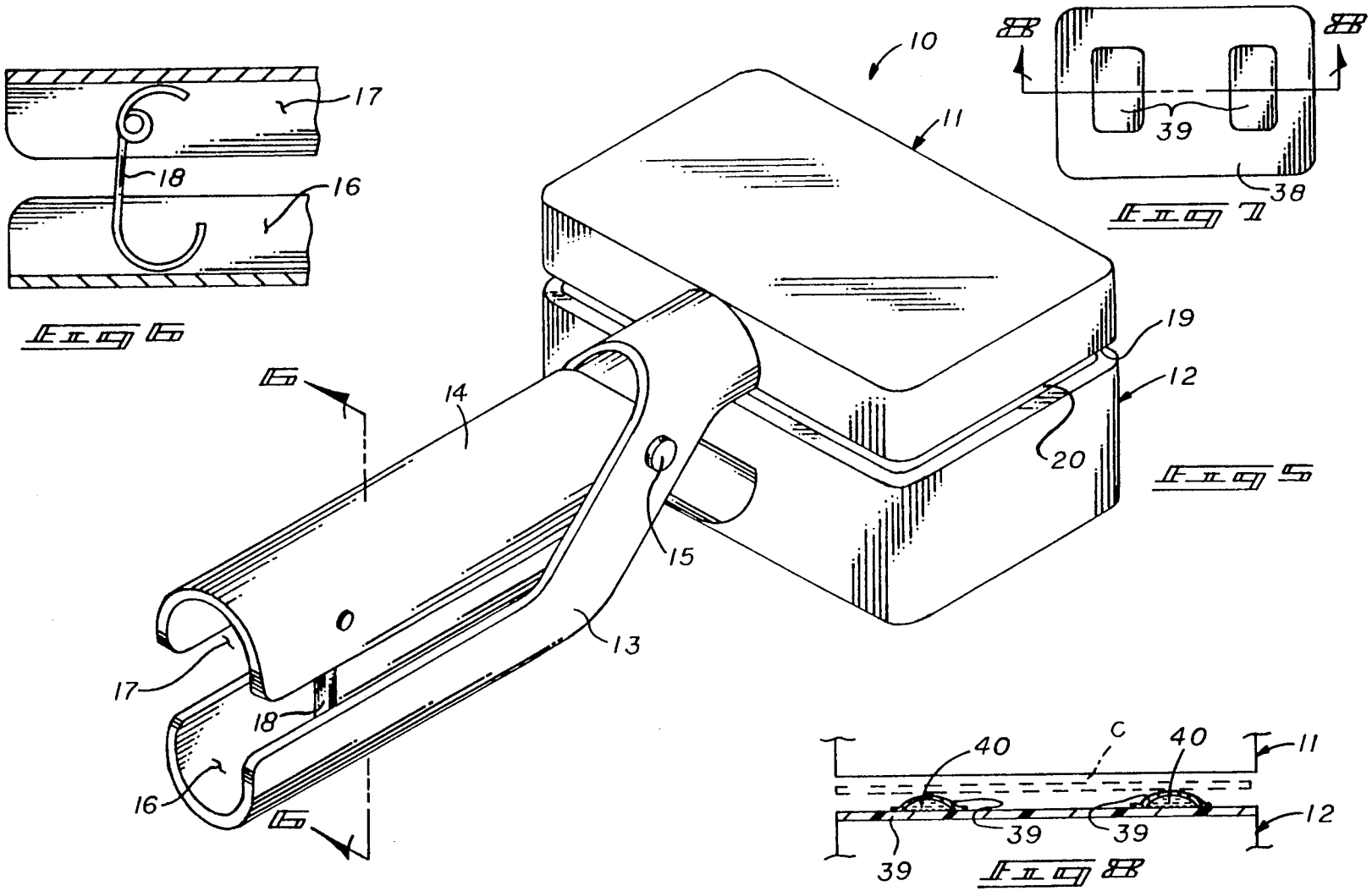
FIG. 5 is an isometric illustration of the invention.
FIG. 6 is an orthographic view, taken along the lines 6—6 of FIG. 5 in the direction indicated by the arrows.
FIG. 7 is an orthographic view of a laminate member arranged for mounting to the credit card structure.
FIG. 8 is an orthographic view, taken along the lines 8—8 of FIG. 7 in the direction indicated by the arrows.
Figures 2, 3:
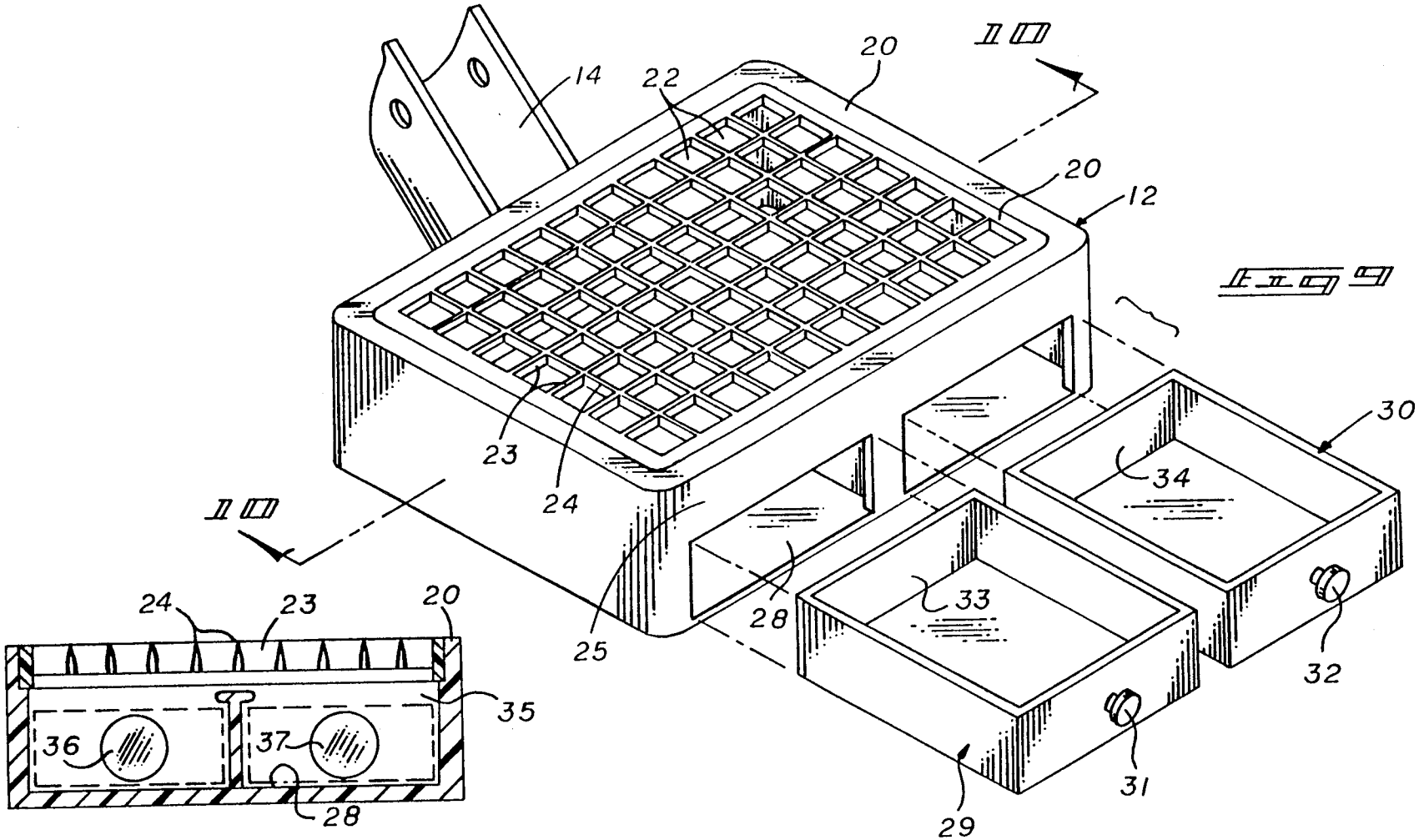

The FIGS. 7 and 8 indicate the use of a flexible web 38 having a plurality of frangible capsules 39 mounted thereon, each containing a fluid adhesive 40. The flexible web 38 is positioned upon the second housing cutter wall 20 coextensively overlying the second housing cutter wall and the first and second cutter blades 23 and 24. The flexible web 38 then is arranged to receive a credit card "C" positioned upon the frangible capsules 39 in a coextensive relationship with the flexible web 38. Upon projecting the first housing 11 towards the second housing 12, the fluid adhesive 40 is projected from the capsules 39 and directed about the credit card "C" to fixedly secure the flexible web 38 onto the credit card and thereby further mask the identity of the credit card as the flexible web 38 is subsequently a laminate directed over the credit card in use of the organization.

Figures 11, 12:
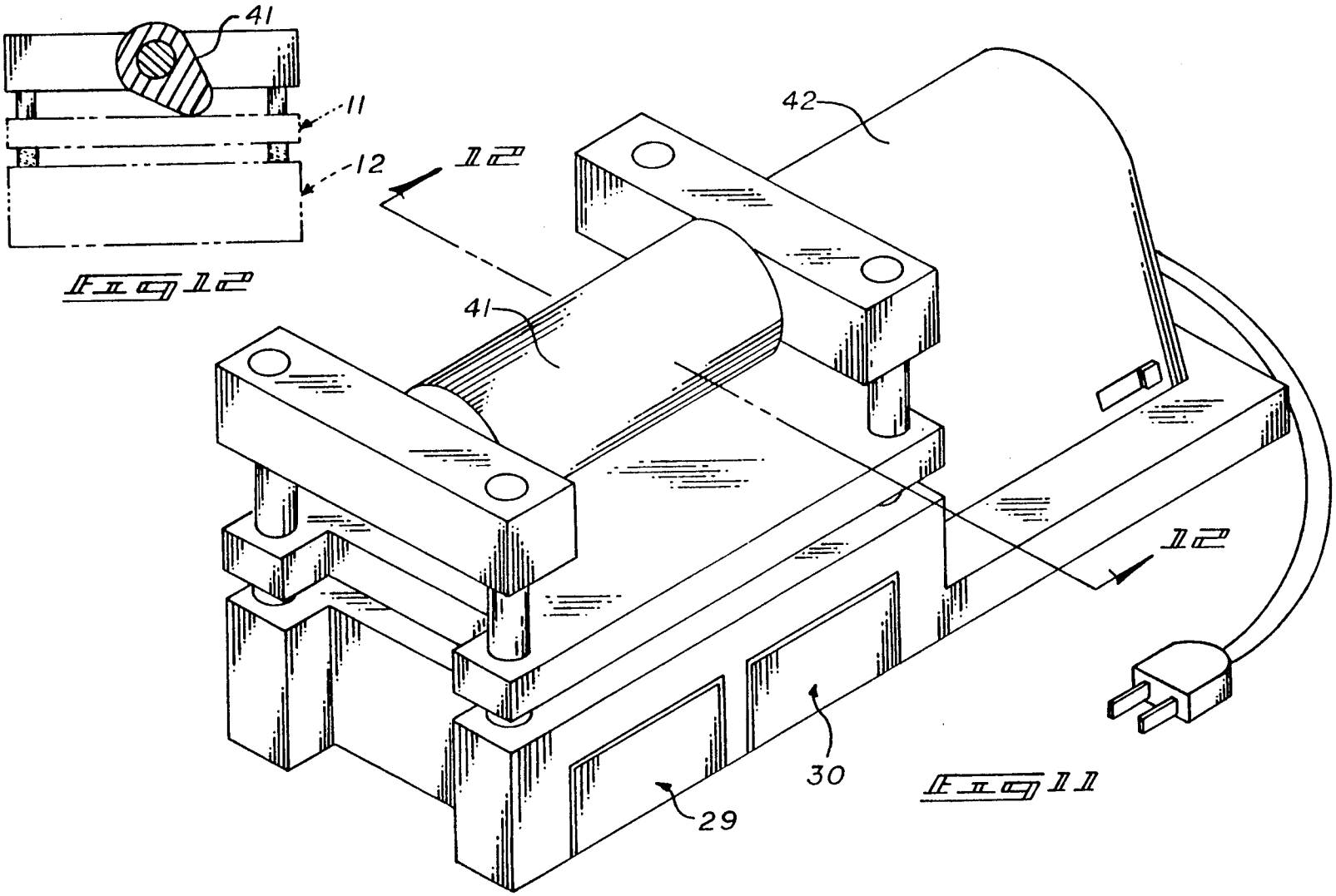
FIG. 11 is an isometric illustration of a motorized aspect of the invention.
FIG. 12 is an orthographic view, taken along the lines 12—12 of FIG. 11 in the direction indicated by the arrows.

FIGS. 11 and 12 indicate a motorized aspect of the invention, wherein a drive motor 42 is arranged to effect rotation of a cam member 41, wherein the cam member is arranged for impingement upon a top wall of the first anvil housing 11 to effect reciprocation of the first anvil housing to the second anvil housing, with spring members interposed between the first and second anvil housings about post members to maintain spacing of the anvil housing apart permitting positioning of credit cards therein. Such devices as drive belts and the like may be utilized to feed credit cards and the like between the punch and die structure, as indicated in FIGS. 11 and 12.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A card dicer apparatus, comprising, a first anvil wall housing in facing relationship relative to a second anvil housing, wherein the first anvil housing includes a first anvil housing rear wall, the second anvil housing having a second anvil housing rear wall, a first handle fixedly mounted to the first anvil housing rear wall, a second handle fixedly mounted to the second anvil housing rear wall, with the first handle and the second handle arranged in a crossed relationship, and a handle axle directed through the first handle and the second handle parallel to the first anvil housing rear wall and the second anvil housing rear wall permitting pivoting of the first handle relative to the second handle, and the first handle having a first handle groove, the second handle having a second handle groove, and a spring interposed within the first handle groove and the second handle groove to maintain spacing of the first handle relative to the second handle, and spacing of the first handle housing relative to the second handle housing, and the first anvil housing having a first anvil housing punch wall with the second anvil housing having a second anvil housing cutter wall, the first anvil housing punch wall arranged in a confronting cooperative relationship relative to the second anvil housing cutter wall, wherein the first anvil housing punch wall and the second housing cutter wall are arranged in coextensive relationship, and a matrix of parallel lug members fixedly mounted to the first housing punch wall in an orthogonal relationship extending beyond the first handle housing punch wall, and the second anvil housing cutter wall includes a plurality of rows of first cutter blades orthogonally intersecting a plurality of further rows of second cutter blades, wherein the first cutter blades and the second cutter blades cooperate to define lug openings therebetween, wherein each of the lug members is arranged for reception within one of said lug openings on projection of the first housing punch wall towards the second housing cutter wall, and the second housing includes a second housing front wall spaced from the second housing rear wall, and the second housing front wall includes at least one opening, and including a second housing floor extending between the second housing rear wall and the second housing front wall, wherein the at least one opening extends to the second housing floor, and a container arranged for sliding engagement with the second housing floor extending from the second housing front wall to the second housing rear wall.

2. An apparatus as set forth in claim 1 wherein the container includes a container rear wall formed of a ferrous metallic material, wherein the second housing rear wall includes a magnetic plate for magnetic adherence of the container rear wall to the second housing rear wall.

3. An apparatus as set forth in claim 2 including a flexible web arranged for positioning between the first housing punch wall and the second housing cutter wall, wherein the web includes a plurality of frangible capsules, with each of said capsules having a fluid adhesive therewithin, whereupon positioning of a credit card on the capsules between the first housing punch wall and the second housing cutter wall effects adherence of the flexible web to the credit card.

* * * * *